US011702966B2

(12) United States Patent
Hayder et al.

(10) Patent No.: US 11,702,966 B2
(45) Date of Patent: Jul. 18, 2023

(54) FLUID PAN AND MOTOR VEHICLE

(71) Applicant: Bayerische Motoren Werke Aktiengesellschaft, Munich (DE)

(72) Inventors: Rene Hayder, Strengberg (AT); Michael Hutsteiner, Adlwang (AT); Gerwin Ott, Steyr (AT); Egon Pibinger, Pasching (AT); Reinhard Ratzberger, Steyr (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/779,940

(22) PCT Filed: Nov. 23, 2020

(86) PCT No.: PCT/EP2020/083038
§ 371 (c)(1),
(2) Date: May 25, 2022

(87) PCT Pub. No.: WO2021/115769
PCT Pub. Date: Jun. 17, 2021

(65) Prior Publication Data

US 2023/0003146 A1 Jan. 5, 2023

(30) Foreign Application Priority Data

Dec. 9, 2019 (DE) ..... 10 2019 133 472.1

(51) Int. Cl.
*F01M 11/00* (2006.01)

(52) U.S. Cl.
CPC . *F01M 11/0004* (2013.01); *F01M 2011/0066* (2013.01); *F01M 2011/0091* (2013.01)

(58) Field of Classification Search
CPC ..... F01M 11/0004; F01M 2011/0066; F01M 2011/0091; F01M 2011/005; F01M 2011/0087; F01M 1/02; F01M 5/007
See application file for complete search history.

(56) References Cited

U.S. PATENT DOCUMENTS

2010/0162988 A1* 7/2010 Enokida ..... F01M 11/0004 123/195 C

FOREIGN PATENT DOCUMENTS

DE 10 2007 060 273 A1 6/2009
DE 102007060273 A1 * 6/2009 ..... F01M 11/0004
DE 10 2011 016 226 A1 12/2011
(Continued)

OTHER PUBLICATIONS

International Search Report (PCT/ISA/210) issued in PCT Application No. PCT/EP2020/083038 dated Feb. 2, 2021 with English translation (six (6) pages).
(Continued)

*Primary Examiner* — Syed O Hasan
(74) *Attorney, Agent, or Firm* — Crowell & Moring LLP

(57) ABSTRACT

A fluid pan for a motor vehicle has a main pan and a secondary pan that is separate from the main pan, wherein the main pan has a main space for fluid and a passage is provided on a side wall of the main pan. The secondary pan has a secondary space and an opening, wherein the secondary pan is attached to the side wall of the main pan in such a manner that the opening of the secondary pan connects to the passage of the main pan and thus the main space and the secondary space are fluidically connected.

19 Claims, 2 Drawing Sheets

(56) References Cited

FOREIGN PATENT DOCUMENTS

| | | | | | |
|---|---|---|---|---|---|
| DE | 102010044403 | A1 | * | 4/2012 | ..... F01M 11/0004 |
| DE | 10 2014 007 285 | A1 | | 11/2015 | |
| EP | 1 688 595 | A2 | | 8/2006 | |
| JP | 2005-83217 | A | | 3/2005 | |
| JP | 2007297972 | | * | 12/2008 | ..... F01M 11/0004 |

OTHER PUBLICATIONS

German-language Written Opinion (PCT/ISA/237) issued in PCT Application No. PCT/EP2020/083038 dated Feb. 2, 2021 (three (3) pages).

German-language Search Report issued in German Application No. 10 2019 133 472.1 dated Oct. 5, 2020 with partial English translation (11 pages).

* cited by examiner

FLUID PAN AND MOTOR VEHICLE

FIELD

The invention relates to a fluid pan, in particular an engine oil pan, for a motor vehicle, and also to a motor vehicle.

BACKGROUND AND SUMMARY

Fluid pans in motor vehicles serve to receive fluids which are important to the running of the motor vehicle. One example of a fluid pan is the engine oil pan.

Fluid pans should be compact, but at the same time have the largest possible volume for receiving fluid.

The problem addressed by the invention is that of providing a fluid pan, whereof the volume for receiving fluid can be enlarged in a straightforward manner.

This problem is solved in accordance with the invention by a fluid pan, in particular an engine oil pan, for a motor vehicle, which has a main pan and a secondary pan which is separate from the main pan, wherein the main pan has a main space for fluid and a passage is provided on a side wall of the main pan. The secondary pan in this case has a secondary space and an opening, wherein the secondary pan is attached to an outer side of the main pan in such a manner that the opening in the secondary pan connects to the passage in the main pan, and the main space and the secondary space are thereby fluidically connected to one another. The secondary space of the secondary pan therefore represents a separate enlargement of the main space of the main pan. In this way, more fluid can be received in the fluid pan.

The passage in the main pan may be there for production-related reasons and must be tightly closed by a separate cover. This function is assumed by the secondary pan, which thereby simultaneously increases the total volume of the main pan. The secondary pan therefore has a dual function as a cover and as a means of increasing the volume.

Within the framework of this invention, a side wall is understood to mean a wall which delimits the main pan to the side, i.e. in a horizontal direction in the anticipated assembly position. In particular, the floor of the main pan does not represent a side wall.

In particular, the main space is enlarged substantially laterally or, in other words, the secondary pan is attached to the main pan in such a manner that it projects substantially horizontally from a lateral side wall of the main pan. Accordingly, the main pan is not enlarged downwardly.

According to one aspect, the secondary pan can be attached to the outside of the main pan in a non-destructively detachable manner. Hence, the secondary pan can easily be mounted on the main pan or dismantled from said main pan, which is advantageous when the fluid is being changed, for example.

A further aspect envisages that the passage is arranged at least partially, in particular completely, below a predefined maximum filling height of the main pan. Hence, the additional main space created by the secondary space can be efficiently utilized.

In particular, the maximum filling height is selected in such a manner that no moved components, for example components of the crankshaft, splash about in the fluid received in the main space and secondary space. Air is thereby prevented from being introduced into the fluid.

It may be provided that the secondary space is partially arranged in the predefined assembly position, in particular substantially completely above a lowest point of the opening. In this way, the secondary space can be prevented from having a dead volume of fluid, which remains in the secondary pan when the fluid level drops and, consequently, cannot be used for its actual purpose.

By way of example, the secondary space of the secondary pan has a minimum volume of 0.1 liters, in particular 0.5 liters. Hence, an appreciable increase in volume of the main space can be achieved. The secondary pan is not therefore a "flat cover", but contributes to the increase in volume of the main space.

One embodiment envisages that the passage is enclosed circumferentially by a contact face, and that the opening in the secondary pan is enclosed circumferentially by a contact face, wherein the contact faces rest against one another, or a seal, for example a flat seal or a paste-like seal, is provided between the contact faces. Hence, the main pan and the secondary pan can be attached to one another in a simple and, in particular, sealing manner, and the fluidic connection between the main space and the secondary space can thereby be created.

Optionally, one contact face is, or both contact faces are, designed in a flange-like manner. As a result, easier fastening can be guaranteed. Furthermore, separate fastening components, such as screws or rivets, for example, are more easily accessible from outside via the flange-like portion during fastening.

It may be provided that the main pan and the secondary pan are only fastened to one another via their contact faces. This allows simpler and easier assembly and dismantling, and additional separate components, such as fastening components, for example, can be dispensed with.

In a further embodiment, at least one fastening means is provided, by way of which the secondary pan can be attached to the main pan, at least in the region of the opening in the secondary pan and the passage in the main pan. This makes it easier for the secondary pan to be mounted on, and dismantled from, the main pan, since the fastening means is easily accessible from outside.

The fastening means in this case may be integrally formed on the respective pan, as a result of which the corresponding pan can be produced in one process step.

It may be provided that the contact face of the main pan and/or the contact face of the secondary pan has the at least one fastening means, or that the contact face of the main pan and/or the contact face of the secondary pan is formed at least sectionally by the at least one fastening means. In other words, the fastening means may be at least an integral part of the contact face of the main pan and/or of the contact face of the secondary pan.

The secondary pan may be composed of at least two pan parts, each of which forms a part of the secondary space, in particular wherein the pan parts are two pan halves of the secondary pan. For more complex pan shapes of the secondary pan, production can be substantially simplified if multiple pan parts are produced individually and subsequently assembled into a secondary pan.

In order to ensure a tight and reliable connection between the individual pan parts, said pan parts may be connected to one another in a substance-bonded manner, for example by welding or adhering.

Alternatively, the secondary pan may have an integral design, as a result of which fewer production steps are necessary and no additional tight connection has to be produced between the individual pan parts.

For example, the main pan is made of metal or a metal alloy and a casting, in particular a pressure die-casting. In this way, a stable and resistant main pan can be produced cost-effectively.

It may be provided that a cross-sectional face of the passage in the main pan is substantially parallel to a main demolding direction of the main pan. In this context, "substantially" means a maximum deviation of the cross-sectional face of the passage from the parallel to the main demolding direction of at most 30°.

The secondary pan is produced from a plastic and/or by injection-molding, for example. Hence, the secondary pan can be produced easily and cost-effectively and has a low empty weight.

One embodiment envisages that a cross-sectional face of the opening of the secondary pan is at most 10%, in particular at most 50%, of a side face of the secondary pan facing the main pan, or at least 90%, in particular at least 80%, of a side face of the secondary pan facing the main pan. In this way, the opening in the secondary pan can be adapted to the passage in the main pan, to which the secondary pan is attached.

In addition, the problem is solved by a motor vehicle which comprises an engine and a fluid pan of the aforementioned kind, in particular wherein the fluid pan is an engine oil pan of the engine. Fluid which is essential to the running of the motor vehicle can be collected in the fluid pan. Reliable running of the motor vehicle is thereby guaranteed.

For example, the fluid pan is an engine oil pan of the engine, in which the engine oil which is essential to lubricating and cooling the engine is received.

The motor vehicle may have at least one further vehicle component in the vicinity of the fluid pan, wherein the shape of the secondary pan is adapted to the at least one adjacent vehicle component, in such a manner that the secondary pan fills, at least partially, in particular predominantly, the space between the main pan and the at least one vehicle component. In this way, the installation space within the vehicle can be optimally utilized.

So that even more installation space can be used by the secondary pan to increase the volume of the main pan, the secondary pan may be formed in the region of the at least one vehicle part, at least partially matching the vehicle component.

In particular, the secondary pan has an at least sectionally curved design and at least partially encloses at least one adjacent vehicle component. The available installation space can therefore be utilized efficiently and optimally.

The advantages and features of the fluid pan according to the invention which are described apply in the same way to the motor vehicle according to the invention, and vice versa.

Further advantages and features of the invention result from the following description and also from the attached drawings, to which reference is made.

DETAILED DESCRIPTION OF THE DRAWINGS

Figure 1:
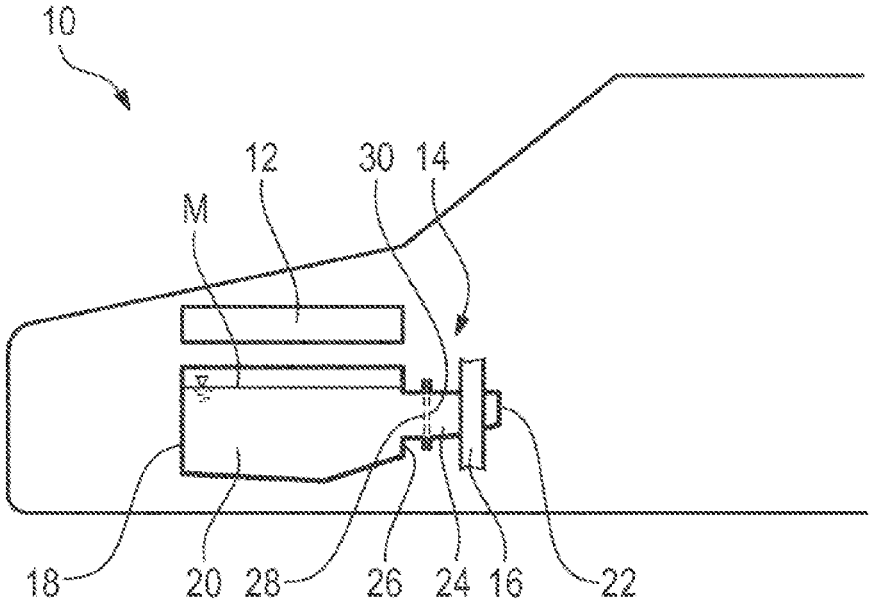
FIG. 1 shows a schematic sectional view of a front region of a motor vehicle according to the invention with a fluid pan according to the invention.

A front region of a motor vehicle 10, in which an engine 12, a fluid pan 14 associated with the engine 12, into which fluid can be filled up to a maximum filling height M, and a further vehicle component 16 are arranged is shown in FIG. 1.

For example, the fluid pan 14 is an engine oil pan of the engine 12 and the further vehicle component 16 is part of a wheel suspension of the motor vehicle 10.

The fluid pan 14 comprises a main pan 18, which has a main space 20, and a secondary pan 22 separate from the main pan 18, which has a secondary space 24.

The directional information used in the following relates to the correct assembly position of the fluid pan 14 in the motor vehicle 10.

A passage 28, to which the secondary pan 22 is fastened in a non-destructively detachable manner, such that said passage 28 and the opening 30 are aligned with one another and the main space 20 and the secondary space 24 are thereby fluidically connected to one another, is formed on one side wall 26, i.e. a lateral outer side, of the main pan 18.

Accordingly, the secondary pan 22 is not fastened to an underside of the main pan 18.

Figure 2:
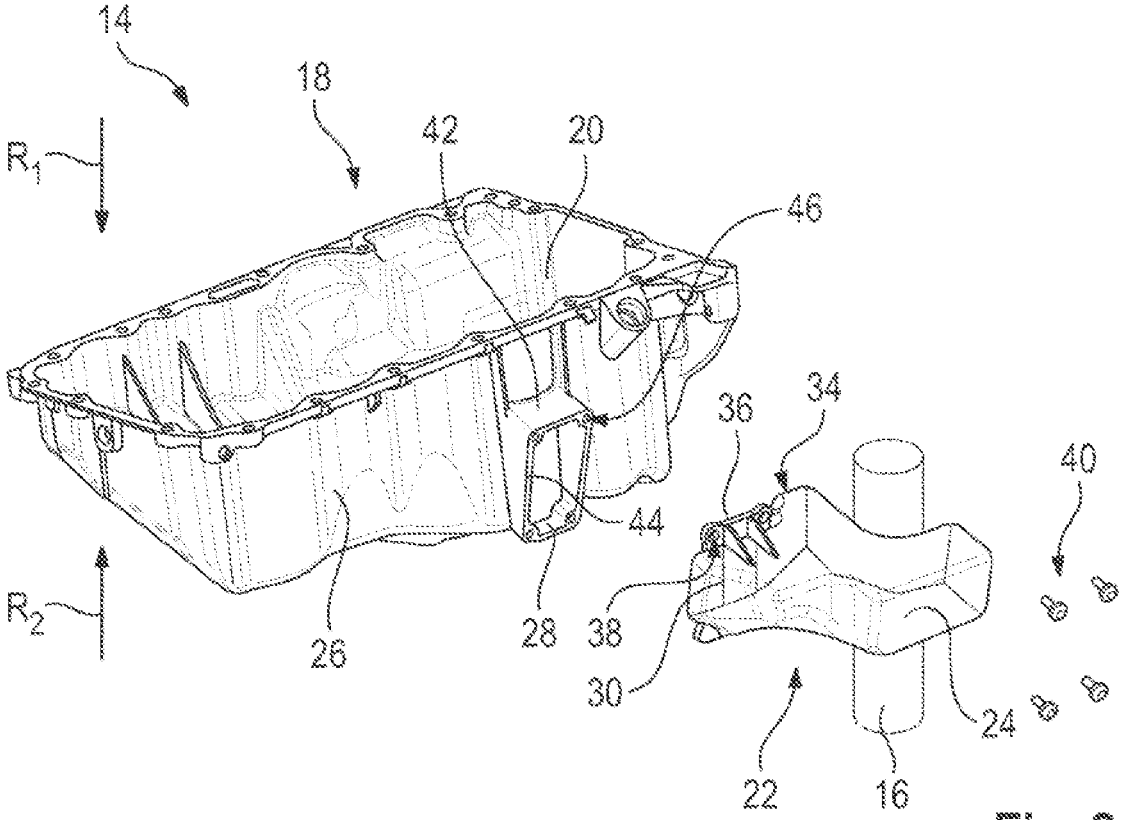
FIG. 2 shows an exploded view of the fluid pan according to the invention, as shown in FIG. 1, with a main pan and a first embodiment of a secondary pan according to the invention.

FIG. 2 shows an exploded view of the fluid pan 14 with the main pan 18, the secondary pan 22, and fastening components 40. Furthermore, the vehicle component 16 is only depicted using dotted lines.

The main pan 18 is a one-piece casting, which can be produced from metal or a metal alloy using a die-casting process, for example. In this case, an inner form of the main pan 18 is demolded in a first main demolding direction $R_1$ and an outer form of the main pan 18 is demolded in a second main demolding direction $R_2$.

In the embodiment of the main pan 18 shown here, a channel 42 is formed on the side wall 26 of the main pan 18 when the die-casting method is used, said channel projecting substantially orthogonally, in other words tilted at a maximum of 30°, outwardly from the side wall 26, and delimiting the passage 28. In other words, a cross-sectional face of the passage 28 is substantially parallel, in other words tilted by a maximum of 30°, to the main demolding directions $R_1$, $R_2$.

A front end of the channel 42 facing away from the side wall 26 forms a contact face 44 of the main pan 18, which surrounds the passage 28 circumferentially.

The contact face 44 has fastening means 46, which in this case are configured as holes or threads for fastening the fastening means 40.

The secondary pan 22 may be produced from metal or plastic, for example, using a casting method, e.g. injection-molding or die-casting. It is a separate component from the main pan 18, in other words produced using a separate production step.

In the region of the opening 30, the secondary pan 22 has a planar contact face 36 which surrounds the opening 30 circumferentially.

In the embodiment shown here, a cross-sectional face of the opening 30 amounts to less than half of a facing side face 34 of the secondary pan 22, when the secondary pan 22 is in the mounted state on the main pan 18.

Fastening means 38, which are designed as holes or threads in this case and which serve to fasten the secondary pan 22 to the main pan 18, are molded on the secondary pan 22. The fastening means 38 in this case form part of the contact face 36.

In particular, the fastening means 38 form a fastening flange.

The secondary pan 22 in the variant shown here has a sectionally curved form, as a result of which it surrounds the vehicle component 16 at least partially.

In this way, the secondary pan 22 is formed in such a manner that it is at least partially adapted to the shape of the adjacent vehicle component 16.

In this case, the secondary pan 22 may have a shape which matches the shape of the adjacent vehicle component 16, at least sectionally.

With the main pan 18 and the secondary pan 22 in an assembled state, the contact faces 36, 44 rest against one another in such a manner that the fastening means 38, 46 lie opposite one another and the opening 30 of the secondary pan 22 is attached to the passage 28 in the main pan 18. In this case, the fastening components 40 interact with the fastening means 38, 46 to fasten the secondary pan 22 to the main pan 18.

For example, the fastening components 40 are inserted through the fastening means 38 of the secondary pan 22 and screwed into the fastening means 46 of the main pan 18.

Optionally, a seal, for example a flat seal or a paste-like seal, may be provided between the contact face 36 and the contact face 44.

In particular, the contact faces 36, 44 each form a flange which is used for fastening and/or for sealing.

In the embodiment of the liquid pan 14 shown here, the main pan 18 and the secondary pan 22 are only fastened to one another by means of their contact faces.

The secondary space 24 therefore represents an increase in volume of the main space 20, as a result of which more fluid can be received in a total space formed by the main space 20 and the secondary space 24. In particular, the volume below the maximum filling height M is increased.

For example, the secondary space 24 of the secondary pan 22 has a minimum volume of 0.1 liters, in particular 0.5 liters. The secondary pan 22 is not therefore a "flat cover", which only closes the passage 28 in the main pan 18.

The secondary pan 22 is formed in such a manner that the secondary space 24 lies completely above a lowest point of the opening 30. It is thereby guaranteed that no dead volume of fluid can accumulate in the secondary space 24.

So that the secondary space 24 in the secondary pan 22 is put to the best possible use, a highest point of the passage 28 and the opening 30 and/or a highest point of the secondary space 24 is below the maximum filling level M of the fluid received in the fluid pan 14.

In order to prevent air from being introduced into the fluid, increased friction between moved parts of the engine 12 and, consequently, a greater power output by the engine 12, the maximum filling level M in this case must be selected in such a manner that the moved parts of the engine 12 do not project into, or splash about in, the fluid.

Figure 3:
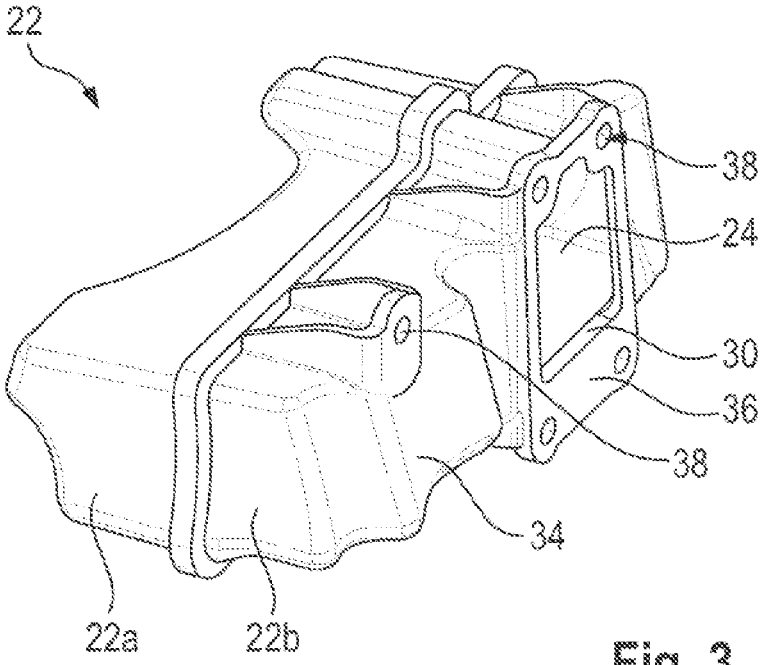
FIG. 3 shows a perspective view of a second embodiment of the secondary pan according to the invention of the fluid pan according to the invention, as shown in FIG. 1.

FIG. 3 represents in detail a secondary pan 22 of a second embodiment, which substantially corresponds to the first embodiment shown in FIG. 2. Consequently, only the differences are dealt with below, and identical and functionally identical parts are provided with the same reference signs.

In the embodiment shown here, the secondary pan 22 is made up of two pan parts 22*a*, 22*b*, which each form part of the secondary space 24. For example, the two pan parts 22*a*, 22*b* are two pan halves of the secondary pan 22.

The two pan parts 22*a*, 22*b* may be produced from metal or plastic, for example, using a casting method, e.g. injection-molding or die-casting. The two pan parts 22*a*, 22*b* may be connected to one another in a substance-bonded manner, for example, by welding or adhering.

Alternatively, the secondary pan 22 may also be integrally formed.

In addition to the fastening means 38 in the region of the contact face 36, a further fastening means 38 is arranged spaced apart from the contact face 36, which is likewise used to fasten the secondary pan 22 to the main pan 18.

Figure 4:
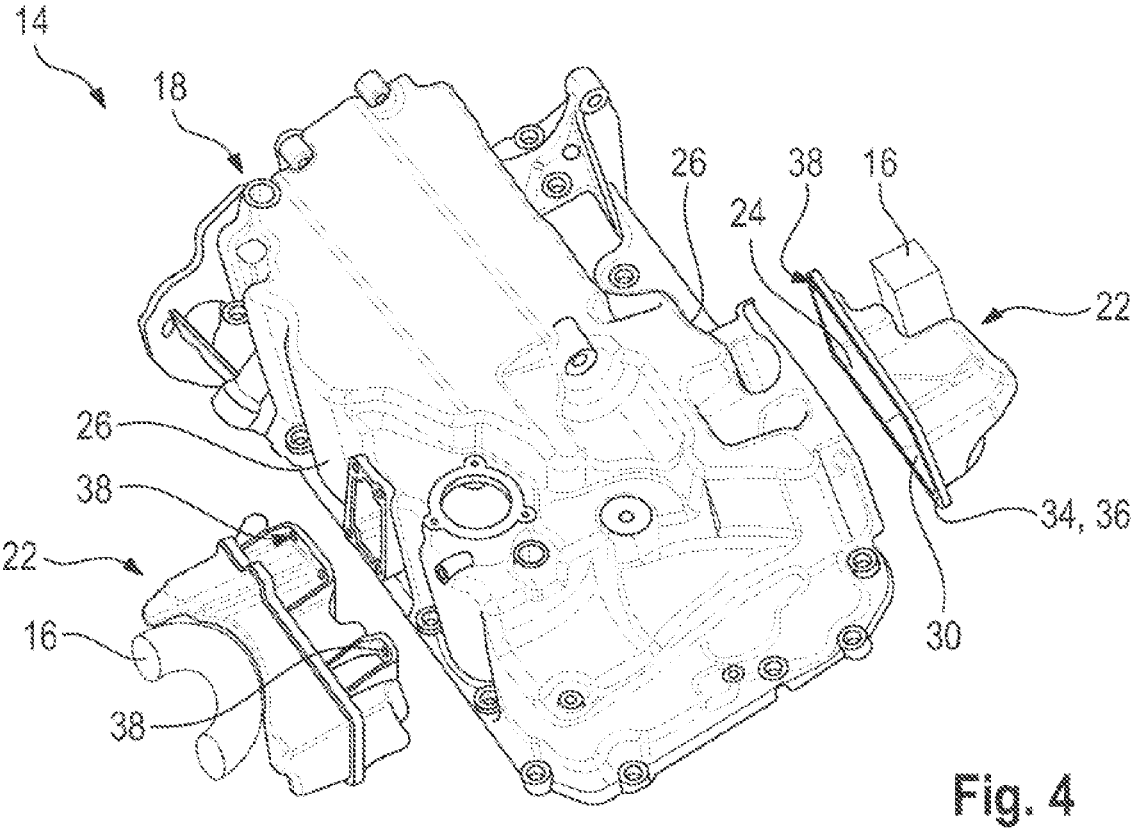
FIG. 4 shows an exploded view of a third embodiment of a fluid pan according to the invention, as shown in FIG. 1, with a main pan and two secondary pans according to the invention.

FIG. 4 shows a further embodiment of the fluid pan 14 with two secondary pans 22, wherein the secondary pan 22 on the right represents a third embodiment of the secondary pan 22. The secondary pan 22 on the left corresponds to the secondary pan 22 in accordance with FIG. 3, and the main pan 18 corresponds to the main pan 18 in accordance with FIG. 2. Accordingly, only the differences are dealt with below, and identical and functionally identical parts are provided with the same reference signs.

The secondary pan 22 on the right has an integral design and has a substantially different shape to the secondary pan 22 on the left. By comparison with the secondary pan 22 on the left, a cross-sectional face of the opening 30 in the secondary pan 22 on the right in relation to a side face 34 of the secondary pan 22 on the right facing the side wall 26 of the main pan 18 is more than 80% or even 90%.

In particular, the side face 34 is formed by the contact face 36.

The contact face 36 of the secondary pan 22 on the right has fastening means 38.

As emerges from FIGS. 2 to 4, the secondary pans 22 may, in general, be of any shape, so that the installation space available between the main pan 18 and the adjacent vehicle components 16 can be optimally utilized.

The invention claimed is:

1. A fluid pan for a motor vehicle comprising:

a main pan; and a secondary pan which is separate from the main pan, wherein the main pan has a main space for fluid and a passage provided on a side wall of the main pan, wherein the secondary pan has a secondary space and an opening, wherein the secondary pan is attached to the side wall of the main pan such that the opening in the secondary pan connects to the passage in the main pan, and the main space and the secondary space are fluidically connected to one another, wherein the secondary space is arranged completely above a lowest point of the opening, and wherein a shape of the secondary pan is adapted to at least one adjacent vehicle component such that the secondary pan fills, at least partially, a space between the main pan and the at least one vehicle component.

2. The fluid pan according to claim 1, wherein the secondary pan is attached to the side wall of the main pan in a non-destructively detachable manner.

3. The fluid pan according to claim 1, wherein the passage is arranged at least partially below a predefined maximum filling height of the main pan.

4. The fluid according to claim 1, wherein the secondary space of the secondary pan has a minimum volume of at least 0.1 liters.

5. The fluid pan according to claim 1, wherein the passage is enclosed circumferentially by a first contact face, and wherein the opening in the secondary pan is enclosed circumferentially by a second contact face, wherein the first contact face and the second contact face at least one of directly contact one another, or are coupled to each other via a seal provided between the first contact face and the second contact face.

6. The fluid pan according to claim 1, further comprising:

at least one fastener that attaches the secondary pan to the main pan in a region of the opening in the secondary pan and the passage in the main pan.

7. The fluid pan according to claim 1, wherein the secondary pan is composed of at least two pan parts, each of which forms a part of the secondary space.

8. The fluid pan according to claim 1, wherein the main pan is made of at least one of a metal or a metal alloy and a casting.

9. The fluid pan according to claim 1, wherein the secondary pan comprises injection-molded plastic.

10. The fluid pan according to claim 1, wherein a cross-sectional face of the opening of the secondary pan is at least one of less than 50% of a side face of the secondary pan facing the main pan or greater than 80% of the side face of the secondary pan facing the main pan.

11. A motor vehicle comprising:

an engine; and the fluid pan according to claim 1, wherein the fluid pan is an engine oil pan of the engine.

12. The motor vehicle according to claim 11, wherein the motor vehicle has the at least one further vehicle component in the vicinity of the fluid pan.

13. The motor vehicle according to claim 11, wherein the secondary pan has an at least sectionally curved design and at least partially encloses at least one adjacent vehicle component.

14. The fluid pan according to claim 2, wherein the passage is arranged completely below the predefined maximum filling height of the main pan.

15. The fluid according to claim 4, wherein the secondary space of the secondary pan has a minimum volume of 0.5 liters.

16. The fluid pan according to claim 7, wherein the at least two pan parts of the secondary pan are two pan halves of the secondary pan.

17. The fluid pan according to claim 1, wherein the main pan is made a pressure die casting.

18. The fluid pan according to claim 1, further comprising:

an additional secondary pan separate from the main pain and the first secondary pan, wherein the main pan comprises a second passage provided on another sidewall of the main pan, wherein the additional secondary pan has an additional secondary space and an additional opening, wherein the additional secondary pan is attached to the another side wall of the main pan such that the additional opening in the additional secondary pan connects to the second passage in the main pan, and the main space and the additional secondary space are fluidically connected to one another.

19. The fluid pan according to claim 18, wherein the second passage is arranged completely below the predefined maximum filling height of the main pan.

* * * * *